US010259212B2

(12) United States Patent
Raemaekers

(10) Patent No.: US 10,259,212 B2
(45) Date of Patent: Apr. 16, 2019

(54) CUTTING ASSEMBLY FOR A MULTI-ROLL PRINTER

(71) Applicant: OCÉ HOLDING B.V., Venlo (NL)

(72) Inventor: Cyrillus J. M. F. C. Raemaekers, Boulogne-Billancourt (FR)

(73) Assignee: OCÉ HOLDING B.V., Venlo (NL)

( * ) Notice: Subject to any disclaimer, the term of this patent is extended or adjusted under 35 U.S.C. 154(b) by 100 days.

(21) Appl. No.: 15/434,705

(22) Filed: Feb. 16, 2017

(65) Prior Publication Data

US 2017/0232728 A1 Aug. 17, 2017

(30) Foreign Application Priority Data

Feb. 17, 2016 (EP) ..... 16156091

(51) Int. Cl.

| | |
|---|---|
| ***B26D 1/18*** | (2006.01) |
| ***B26D 5/00*** | (2006.01) |
| ***B26D 7/32*** | (2006.01) |
| ***B41F 23/00*** | (2006.01) |
| ***B65H 29/20*** | (2006.01) |
| ***B65H 35/00*** | (2006.01) |

(Continued)

(52) U.S. Cl.

CPC ..... *B41F 23/00* (2013.01); *B26D 5/00* (2013.01); *B26D 7/32* (2013.01); *B65H 29/20* (2013.01); *B65H 35/0006* (2013.01); *B65H 35/08* (2013.01); *B26D 1/185* (2013.01); *B26D 2007/005* (2013.01); *B26D 2007/322* (2013.01); *B41J 11/70* (2013.01); *B41J 15/22* (2013.01)

(58) Field of Classification Search

CPC ..... B65H 2301/515; B65H 2301/5151; B65H 2301/51512; B65H 2301/515123; B65H 35/0006; B65H 35/08; B65H 29/20; B41F 23/00; B41F 13/60; B41F 19/008; B26D 5/00; B26D 7/32; B26D 2007/005; B26D 2007/322; B26D 1/185; B41J 11/70; B41J 15/22

See application file for complete search history.

(56) References Cited

U.S. PATENT DOCUMENTS 4,179,109 A * 12/1979 Harris ..... B41F 13/54 270/52.08
4,344,557 A * 8/1982 Lerner ..... B65D 33/002 206/820

(Continued)

FOREIGN PATENT DOCUMENTS

EP 2 340 918 A1 7/2011
JP 2004302284 A * 10/2004 ..... G03B 27/32
WO WO 2016/028273 A1 2/2016

*Primary Examiner* — David H Banh
(74) *Attorney, Agent, or Firm* — Birch, Stewart, Kolasch & Birch, LLP

(57) ABSTRACT

Method for cutting media from a multi-roll printing system, comprising the steps of:

selecting one of a first medium and a second medium, which first medium and second medium are output in parallel with respect to one another from the multi-roll printing system;

transporting the selected medium to a cutting media transport path spaced apart from a further media transport path in a traverse direction perpendicular to a plane of the cutting media transport path; and cutting the selected medium positioned at the cutting media transport path.

The present invention further relates to a cutting assembly and a multi-roll printing system.

16 Claims, 8 Drawing Sheets

(51) Int. Cl.

| | |
|---|---|
| ***B65H 35/08*** | (2006.01) |
| *B26D 7/00* | (2006.01) |
| *B41J 11/70* | (2006.01) |
| *B41J 15/22* | (2006.01) |

(56) References Cited

U.S. PATENT DOCUMENTS

| | | | | |
|---|---|---|---|---|
| 4,700,627 | A | 10/1987 | Hagler | |
| 4,799,413 | A * | 1/1989 | Soderqvist | B26D 1/225 83/355 |
| 6,202,271 | B1 * | 3/2001 | Goda | B21D 31/043 29/2 |
| 6,460,844 | B1 * | 10/2002 | Clifford | B65H 39/06 270/52.09 |
| 7,277,114 | B2 * | 10/2007 | Konagaya | B41J 15/22 347/262 |
| 2005/0186010 | A1 * | 8/2005 | Shibata | B26D 7/015 400/621 |

* cited by examiner

CUTTING ASSEMBLY FOR A MULTI-ROLL PRINTER

BACKGROUND OF THE INVENTION

1. Field of the Invention

The invention relates to a method for cutting media from a multi-roll printing system, a cutting assembly for a multi-roll printing system, and a multi-roll printing system.

2. Description of Background Art

A multi-roll or tandem roll printing system comprises a plurality of media rolls provided on a common roll support axis. When driving the roll support axis, the media rolls rotate at the same rotational speed. The media supplied from the media rolls are then advanced in a synchronous motion across a transport path of the printing system towards an inkjet printing assembly, which swath-wise prints a respective image on each of the media. Downstream of the inkjet printing assembly a cutting device is provided for cutting the regions of the media comprising the printed images from the remainder of each of the respective media. The cutting device is generally a knife provided on a guide rail extending across the full width of the transport path for the media. The knife simultaneously cuts all the media output by the multi-roll printer in a single stroke. However, when the printing of a first image on a first medium is completed before the printing of a second, for example longer, image on a second medium, cutting cannot be performed before completion of printing the second image to avoid cutting into the second image. Cutting is performed after completion of the second image. Since the media move in tandem, a section of the first medium will be unprinted and will, after simultaneous cutting, be attached to the region with the first image. This unprinted section is then removed in a separate (and a generally manual) cutting operation. For certain print jobs, the costs of media are very high, for example several hundreds of dollars or euros per meter. As the unprinted section is discarded, thereby wasting precious material. Thereby, the material and operational costs for such a multi-roll printing system are relatively high.

In another multi-roll printing system according to the prior art, the knife is controlled to move along the guide rail over a distance corresponding to the width of the medium being cut. During transport of the media, the knife is positioned in between two media. Drawback of said prior printing system is the risk of damage to media. When the knife is not accurately controlled, it cuts into the medium adjacent the medium being cut, for example due to overshoot. Further drawback is that the knife may only cut adjacent media. When three or more separate media are output in parallel, configurations arise wherein the knife is separated from the to be cut medium by another medium, preventing the knife from cutting the desired medium. Operation of such a printing system becomes relatively complex when using higher numbers of media.

SUMMARY OF THE INVENTION

It is an object of the invention to provide a versatile method for cutting media output by a multi-roll printing system, wherein the risk of damaging the media as well as the operational costs are reduced.

In accordance with the present invention, a method according to claim 1 and a cutting assembly according to claim 8 are provided.

The present invention provides a method for cutting media from a multi-roll printing system, the method comprising the steps of:

designating or selecting one of a first medium and a second medium as a to be cut medium (or a selected medium), which first medium and second medium are output in parallel with respect to one another from the multi-roll printing system;

transporting the designated medium to a cutting media transport path spaced apart from a further media transport path in a traverse direction perpendicular to a plane of the cutting media transport path such that, when viewed in the traverse direction, the designated medium on the cutting media transport path is non-overlapping with a medium on the further media transport path; and cutting the designated medium positioned at the cutting media transport path.

The first and second media are provided as media rolls on a roll support, such as a common axis, which roll support is rotated to advance the media parallel to one another along a main media transport path. The media then move in tandem towards the inkjet printing assembly, where respective images are deposited on the media. The images are preferably printed in consecutive swaths and the media are stepwise advanced in between the printing of said swaths to position the media with respect to print head(s) of the inkjet printing assembly. Any plurality of media may be provided on the roll support.

One of the media is designated or selected and thereby identified as the selected or designated medium. Selection herein implies designation and vice versa. In an example, said selection or designation is performed based on the length of the images to be printed or printed on the media. Preferably the medium corresponding to the image with the shorter length along a transport direction of the media is designated or selected. This selected or designated medium is then transported to a cutting media transport path. There, in said example, the medium corresponding to the shorter image is positioned to be cut. This cutting media transport path is positioned at a distance from a further media transport path in a direction traverse to a transport direction of a medium on the cutting media transport path. The cutting media transport path and the further media transport path are further positioned next to one another, when viewed in the traverse direction. The media are output on parallel lanes of the main media transport path and the cutting media transport path and the further media transport path extend generally in the direction of their respective lane of the main media transport path. In a basic example, the cutting media transport path and the further media transport path are positioned at different heights. In the example used, the medium with the longer image is positioned above or below the selected or designated medium with the shorter image. The selected or designated medium positioned at the cutting media transport path is then cut by actuating a cutting device. Since the first and second media are spaced apart, preferably vertically spaced apart, the second medium is not cut by the cutting action. In the given example, the cutting device moves through a horizontal plane of the selected medium above or below a plane of the medium with the longer image. The present invention allows the media to be retracted over the main media transport path, such that no media needs to be wasted, reducing the operational costs of the printing system. Damage to the medium with the longer image is effectively prevented. Thereby the object of the present invention has been achieved.

More specific optional features of the invention are indicated in the dependent claims.

In a preferred embodiment, the step of selecting or designating one of the first medium and the second medium further comprises comparing first print job data for a first image to be printed on the first medium to second print job data for a second image to be printed on the second medium. The images to be printed on the first and second media respectively are compared to one another, specifically their dimensions or lengths in the transport direction of the media. By comparing the image lengths for a plurality of media, the media may be designated or selected for forming a cutting order, e.g. from short to long. Thus, the print job data allows for an efficient selection or designation of the media for optimizing the cutting process, allowing the cutting assembly to operate without operator input or interference. Preferably, the position of the media along their respective transport paths is further determined or sensed for determining the position of cutting lines or regions of the respective media, where said media are to be cut by the cutting device.

In another embodiment, the method according to the present invention further comprises the step of positioning a cutting device and the selected medium (being the designated medium) with respect to one another at the cutting media transport path for cutting the designated or selected medium. The designated or selected medium and the cutting device are positioned, such that the cutting device is positioned for cutting the designated or selected medium. In a first embodiment, the cutting device may be moved to a position of the designated or selected medium at the cutting media transport path, while in a second embodiment the designated or selected medium may be moved to the position of the cutting device at the cutting media transport path. In the first embodiment, the cutting device is moveable in the traverse direction, whereas in the second embodiment a switch device may be provided for guiding the designated or selected medium from a main media transport path directly downstream of the inkjet printing assembly to the cutting media transport path. This provides flexibility by allowing the cutting position to be changed. The first and second embodiment may be combined to yield an even more versatile system.

In a further embodiment, the method according to the present invention further comprises the steps of:

if the cutting step comprises simultaneously cutting the first medium and the second medium, transporting the other of the first medium and the second medium to a similar level in the traverse direction as the cutting media transport path; and if the cutting step comprises consecutively cutting the first medium and the second medium, transporting the other of the first medium and the second medium to the further media transport path positioned spaced apart from the plane of the cutting media transport path in the traverse direction.

When two or more media are to be cut simultaneously, e.g. in the case of images of equal length printed on the media, the media are transported to a common level with respect to the traverse direction. The media may thus be positioned at equal height to allow the media to be cut in a single cutting action. To this end the media may be transported along parallel transport paths towards a cutting position. By allowing the simultaneous cutting of media, a time-efficient method is provided.

When the media may not be cut simultaneously, in the case of different image lengths, the media are guided to different levels in the traverse direction with respect to one another. For example, the designated or selected medium is transported upwards or downwards with respect to the other medium or media.

In another embodiment, the method according to the present invention further comprises the steps of:

after the step of cutting the selected or designated medium, further transporting the first medium and the second medium in a transport direction;

cutting the other one of the first medium and the second medium; and transporting the first medium and the second medium in a reverse direction opposite to the transport direction.

After cutting the designated or selected medium, the designated or selected medium may be advanced further along cutting media transport path to complete the printing of an image on the other medium. Generally no image is then printed on the designated or selected medium, resulting in a blank space or area of loss on the designated or selected medium, corresponding in length roughly to the difference between the lengths of the images printed on the media. By reversing the rotation of the roll support, this area of loss is at least partially spooled back onto the roll support (or transported upstream of the inkjet printing assembly depending on the length of said area of loss). Thus, the area of loss may be used for further printing, preventing media loss and reducing costs.

In an even further embodiment, the step of transporting the media comprises transporting the second medium in tandem with the first medium. Preferably, the first medium and the second medium are supplied from respectively a first media roll and a second media roll, which first media roll and second media roll are provided on a roll support, and wherein the step of transporting the first medium and the second medium comprises rotating the roll support. During transport, the first and second medium move at equal speed, even when the media move at different levels with respect to one another as seen in the traverse direction. Said speed is determined by the angular velocity of the rotation of the roll support.

In a further aspect, the present invention provides a cutting assembly for a multi roll printing system, which cutting assembly comprises:

a main media transport path for a plurality of media output by a multi-roll printing system;

a switch device or selection device positioned downstream of the main media transport path and arranged for transporting one of the plurality of media to a cutting media transport path and for transporting another one of the plurality of media to a further media transport path, wherein the further media transport path is spaced apart from the cutting media transport path in a traverse direction perpendicular to a plane of the cutting media transport path, such that, when viewed in the traverse direction, a medium on the cutting media transport path is non-overlapping with a medium on the further media transport path; and a cutting device arranged for cutting the one of the plurality of media at the cutting media transport path.

The multi-roll printing system comprises a common roll support holding a media roll for each of the media. By rotating the roll support the media are advanced in a synchronized motion along a transport path towards the inkjet printing assembly, which swath-wise deposits a respective image on each of the media. Downstream of the inkjet printing assembly the main media transport path is arranged for transporting the media towards the switch device. On the main media transport path the media preferably are positioned and move in a single plane defined by the main media transport path. Said plane may extend parallel to a support surface in the inkjet printing assembly for supporting the media during printing. The switch device is arranged for positioning one of the media at the cutting media transport path which is positioned at a level at a distance from a level where the other one of the media has been positioned, as seen in the traverse direction. In a basic example the switch devices may be arranged for raising or lowering one of the media above another one of the media for positioning the media at different height levels. A cutting device is positioned or positionable at the cutting media transport path for cutting the medium positioned at the cutting media transport path. Thereby, the cutting device may cut said medium without the risk of unintended cutting of other media. Thereby, the object of the present invention has been achieved.

In another embodiment, the switch device is further arranged for:

when two media are selected or designated for simultaneous cutting, positioning one of the two media on the cutting media transport path and positioning the other one of the two media at a similar level in the traverse direction as the cutting media transport path; and when two media are selected or designated for consecutive cutting, positioning one of the two media at the cutting media transport path and positioning the other one of the two media on the further media transport path spaced apart from the cutting media transport path in the traverse direction.

The switch device is configured for positioning the media at a common level, such that the media are aligned in a single plane for cutting the media in a single cutting stroke of the cutting device. The cutting device is arranged for cutting the media in a direction perpendicular to both the transport direction of the media as well as to the traverse direction, e.g. a width direction of the media or a transport path, wherein the cutting device moves in a cutting direction across at least the full width of the aligned media and/or the cumulative width of aligned media transport paths whereupon the media are positioned (e.g. a width of main media transport path). When the cutting lines or zones of the media are aligned, e.g. when the printed images have the same length, the media may thus be cut simultaneously in a time-efficient manner. When the cutting zones of the media are not aligned with respect to a cutting direction of the cutting device, the switch device is configured to position a to be cut medium at a different level in the traverse direction than other media. Said to be cut medium may then be cut by positioning the cutting device with respect to said medium at said level and then moving the cutting device in the cutting direction.

In a further embodiment, the cutting assembly according to the present invention further comprises a switch actuator or selection actuator for positioning the cutting device and the one of the plurality of media with respect to one another at the cutting media transport path for cutting the one of the plurality of media. The switch actuator is configured for transporting a to be cut medium from the main media transport path to the level in the traverse direction corresponding to the cutting media transport path and/or moving the cutting device to said level. In one example, the switch actuator may be an actuator for moving the cutting device in the traverse direction, preferably along a guide rail extending in the traverse direction.

In an even further embodiment, the cutting assembly according to the present invention, further comprises a controller arranged for designating or selecting one of the plurality of media based on a comparison between first print job data for a first image to be printed on a first one of the plurality of media and second print job data for a second image to be printed on a second one of the plurality of media. The controller is configured to determine a cutting order of the media based on the dimensions of the respective images to be printed on the media, and preferably on the positions of the media along their respective transport paths. The controller controls the cutting assembly to direct the designated or selected medium to the cutting media transport path. The controller may further be arranged to select one of a plurality of spaced apart media transport paths as the cutting media transport path. Operator time is reduced by implementation of the controller.

In another embodiment, the controller is further arranged for actuating a switch actuator for positioning the cutting device and the designated or selected one of the plurality of media with respect to another at the cutting media transport path based on the relative position of the designated or selected one of the plurality of media with respect to the cutting device. The controller may control the cutting device to move between different levels with respect to the traverse direction or may control the switch device to form a connection between the main media transport path and a transport path at a desired level in the traverse direction. The designated or selected medium is then transported via the switch device to the connected transport path. The controller may control the switch actuator to pivot one or more guide elements between a plurality of pivoting positions, wherein each pivoting position corresponds to a transport path at one of the different levels when viewed along the traverse direction. Preferably, the downstream end of the guide element is positioned at the start of the desired or designated or selected transport path. The controller may further control the number of adjacent or neighboring guide elements to be pivoted, such that the width of said number of guide elements is at least similar to the width of the designated or selected medium. Thereby, a versatile system in obtained.

In another embodiment, the switch device comprises a plurality of guide elements, each of which is pivotable around a pivoting axis to position the guide element with respect to one of the cutting media transport path and the further media transport path, and wherein preferably the controller is arranged for positioning the guide elements in correspondence to a width of a medium. The controller designates or selects the guide elements, specifically their number and/or positions, based on the width and on the lateral position along the width direction of the medium which is to be transported by the designated or selected one or more guide elements to one of the plurality of spaced apart transport paths. The guide elements may be plate or finger elements, each of which may be pivoting by the switch actuator for connecting the main media transport path to one the spaced apart transport paths. The pivoting axis may be provided at a downstream end of the main media transport path and may extend parallel to the cutting direction of the cutting device. The controller controls the switch actuator to pivot a number of guide elements into one of multiple pivoting positions, which one pivoting position corresponds to a designated or selected transport path or level. The cumulative width of the controlled guide elements corresponds to or is similar to the width of the medium which is transported from the main media transport path via said guide elements to the designated or selected transport path or level in the traverse direction. Thereby, the cutting assembly according to the present invention is arranged for processing a wide variety of media widths.

In an embodiment, the main media transport path, cutting media transport path, and the further media transport path each comprise at least two lanes for the at least two media, said lanes extending parallel to one another in the transport direction, and wherein the cutting assembly further comprises at least two transport switches, each of which is positioned at one of the parallel lanes, which at least two transport switches are actuatable by the switch actuator to selectively connect a lane on the main media transport path to a lane on the cutting media transport path or to a lane on the further media transport path. The lanes on the main media transport path, cutting media transport path and the further media transport path are positioned next to one another or are spaced apart from one another in the width direction of the respective transport paths. Preferably, the lanes extend parallel to one another in the transport direction. The cutting media transport path and the further media transport path each comprise a first lane and a second lane for transporting one of the media. When viewed in the traverse direction, the first lane on the cutting media transport path is non-overlapping with the second lane on the further media transport path. The first and the second lane, when viewed in the traverse direction, extend next to one another, spaced apart from one another. The transport switch may be used to connect a lane on the main media transport path to e.g. the first lane of the cutting media transport path or the first lane of the further media transport path. A first transport switch is then positioned at the downstream end of the first the lane of the main media transport path. Similarly, a second transport switch may be provided for the second lane.

In a preferred embodiment, the present invention provides a cutting assembly for a tandem roll printing system comprising:

a plurality of cutting media transport paths spaced apart from one another in a traverse direction perpendicular to a plane of the cutting media transport paths;

a plurality of cutting devices, wherein a cutting device is positioned at each of the cutting media transport paths for cutting a medium on said cutting media transport path;

a switch device downstream of main media transport path, the switch device comprising a plurality of guide elements, each of which is moveable to position the guide element with respect to one of the cutting media transport paths, such that a first medium is transported from the main media transport path to a first cutting media transport path while a second medium is medium is transported from the main media transport path to a second cutting media transport path.

The cutting media transport paths are for example arranged above one another. Each cutting media transport path comprises a cutting device, moveable in the width direction over said cutting media transport path to cut a medium on said cutting media transport path. The cutting media transport paths preferably comprise a width similar to that of the main media transport path. At the downstream end of the main media transport path, the switch device is provided. The guide elements are moveable, preferably pivotable, between the upstream ends of the different cutting media transport paths to connect the main media transport path to a cutting media transport path. The guide elements are positioned besides one another in the width direction of the main media transport path. As such, the number of guide elements connected to specific cutting media transport paths may be chosen in correspondence to the width and position of the medium to be transported to said cutting media transport path. This provides a versatile system capable of adapting to changes in media sizes or the number of media applied.

In a further aspect, the invention provides a multi-roll printing system comprising a cutting assembly according to the present invention. The multi-roll printing system preferably comprises a support roll for holding a plurality of media rolls for supplying the plurality of media. The media move in tandem in a common plane through the printing system to the cutting assembly positioned downstream of the inkjet printing assembly or image forming unit. A roll actuator, such as a step or DC motor, is provided for step-wise rotating the support roll.

In an embodiment, the controller is arranged for actuating the roll actuator to transport the plurality of media in a reverse direction opposite to a transport direction during printing along the main media transport path for positioning a leading edge of the one of the plurality of media cut by the cutting device with respect to the inkjet printing assembly for printing a further image on the one of the plurality of media. After cutting both media, the roll support is rotated, such that the media are at least partially spooled back onto their respective media rolls. The leading edge of the first cut medium (i.e. the relatively longer medium) may this be positioned with respect to the inkjet printing assembly for printing on said medium. An unprinted section of the first medium is avoided, reducing the amount of material required for a print job. Thereby printing costs are reduced. Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE PREFERRED EMBODIMENTS

Figure 1A:
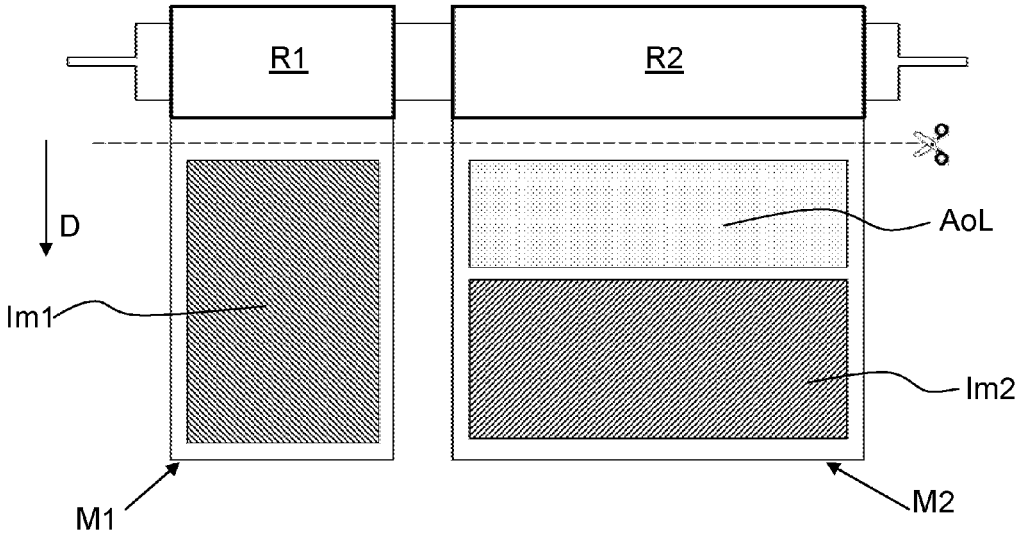
FIG. 1A is a schematic top view of a multi-roll printing system according to the prior art.

The present invention will now be described with reference to the accompanying drawings, wherein the same reference numerals have been used to identify the same or similar elements throughout the several views.

Figure 1B:
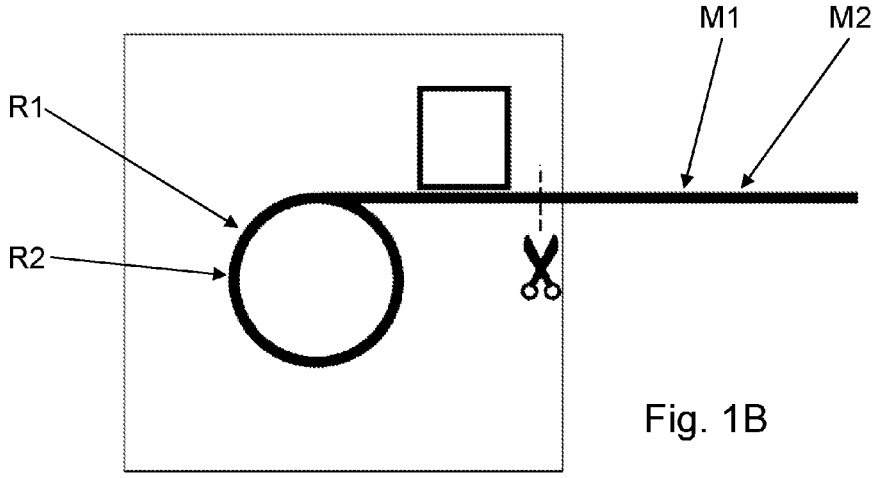
FIG. 1B is a schematic side view of the multi-roll printing system in FIG. 1A.

FIG. 1A and FIG. 1B illustrate schematically a multi-roll printing system according to the prior art. A multi-roll printing system is arranged for the parallel processing or printing of at least two media provided from at least two media rolls. The media move in unison through the printing system by the rotation of a common support axis on which said at least two media rolls are provided. One example of a multi-roll printing system is a tandem printing system, wherein at least two media may be processed in tandem. It will be appreciated that the term tandem herein may further imply the synchronous processing of more than two rolls, e.g. three, four, etc. Two or more media M1, M2 are fed from rolls R1, R2 provided on a common rotation axis onto a main media transport path, along which an image formation unit is provided. The image formation unit deposits in tandem image Im1 on the medium M1 and image Im2 on medium M2. The length of the image Im2 in the transport direction is less than the length of the image Im1. A cutting device, indicated by the scissor-symbol, is arranged for cutting both media M1, M2 in a single cutting motion along the dotted line. To avoid damage to Im1, the cutting device cuts the media M1, M2 after completion of printing the image Im1 with the relative greatest length along the transport direction D. This results in an area of loss AoL on the medium M2, which area of loss AoL is removed from the second medium M2 in an additional, generally manual, cutting step on or by an additional cutting unit. Furthermore, the material of the area of loss AoL is deposed off, resulting in the loss of often relatively costly media.

Figure 2:
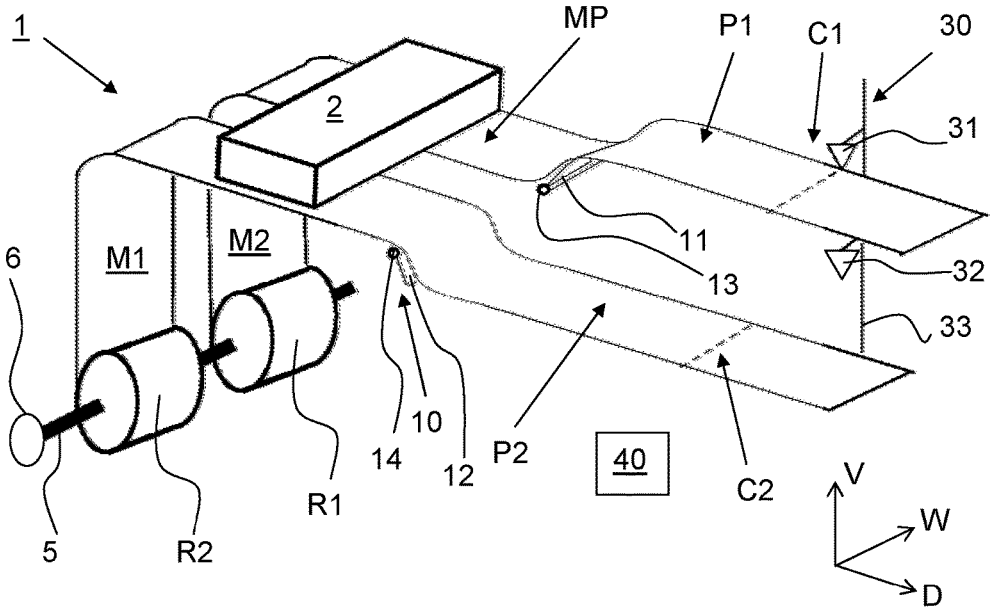
FIG. 2 is a schematic perspective view of an embodiment of a multi-roll printing system according to the present invention.
Figure 3:
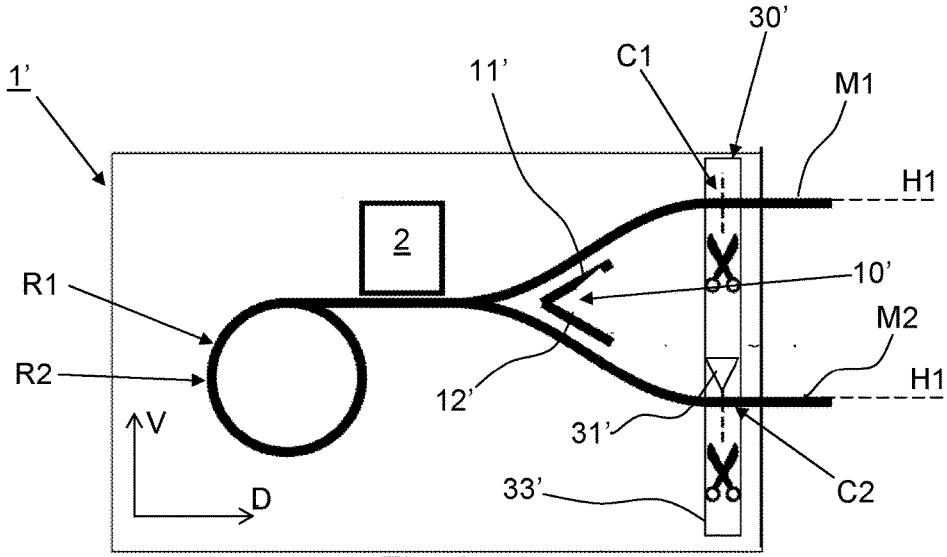
FIG. 3 is a schematic side view of a further embodiment of a multi-roll printing system according to the present invention.

FIG. 2 schematically illustrates a multi-roll printing system 1 according to the present invention. At least two separate media M1, M2 are supplied from rolls R1, R2 provided on a common roll support 5 rotatable around a common rotation axis. From the rolls R1, R2 the media M1, M2 are transported synchronously along the main media transport path MP to the inkjet printing assembly 2, which inkjet printing assembly 2 is shown in detail in FIG. 5. Downstream of the inkjet printing assembly 2, a switch device 10 is provided, comprising at least two guide elements or selector guides 11, 12, each of which directs one of media M1, M2 via one of the transport paths P1, P2 to one of the cutting positions C1, C2. The cutting positions C1, C2 are provided spaced apart from one another in a direction V perpendicular to the plane of the main transport path MP. Said direction V is preferably parallel to the vertical direction V, as shown in FIG. 3. A cutting device 30 is arranged for cutting each of the media M1, M2 at its respective cutting position C1, C2.

Since the media rolls R1, R2 are provided besides one another on the single roll support 5, shown as a single axis or rod in FIG. 2, these rolls R1, R2 rotate in tandem when the common roll support 5 is actuated by means of an actuator 6, such as an electric DC motor or a step motor. The media M1, M2 which are being spooled off from their respective rolls R1, R2, move at the same speed and in the same transport direction D along the main media transport path MP. In FIG. 2, the media rolls R1, R2 are provided below the inkjet printing assembly 2, such that the main or common media path MP comprises a curve or turn. To this end an additional roller or curved support surface may be implemented at said turn for guiding the media M1, M2. Additional rolls may be provided on the roll support 5 for simultaneously advancing and printing three or more media M1, M2. The plurality of rolls R1, R2 on the roll support 5 are rotated synchronously and preferably stepwise to allow the inkjet printing assembly 2 to iteratively print swaths of an image on the media M1, M2. The different media M1, M2 may be similar or deviate from one another in terms of media type, dimensions such as width, material, and/or pretreatment. Prior to printing, print job data is input to the controller 40 to determine the print process.

The main media transport path MP extends at least from the roll support 5 to the inkjet printing assembly 2, which is arranged for applying an image on a top surface of each of the media M1, M2. The inkjet assembly 2 is controlled by a controller 40, which transmits printing instructions to the inkjet printing assembly 2 based on a print job input to the controller 40 by an operator. The controller 40 performs the print job based on print job data defining said print job. The print job data may comprise information or data representing characteristics of the different media M1, M2, for example their lateral positions on the transport path(s), dimensions, media type, current position of the leading edge of each medium M1, M2, and/or data representing the respective images to be printed on each of the media M1, M2. The controller 40 provides at least first image data to the inkjet printing assembly 2 for printing a first image on the first medium M1 and second image data for printing a second image on the second medium M2. The first and second images are printed swath-wise on their respective medium M1, M2. Both images are printed in tandem as the media M1, M2 are transported over the main media transport path MP. In general, the dimensions of the first image on the first medium M1, specifically its length in the direction of the main transport path MP, will be different from the second image on the second medium M2.

Downstream of the inkjet printing assembly 2, the main media transport path MP branches out into a plurality of transport paths P1, P2. Each of these transport paths P1, P2 extends to a respective cutting position C1, C2. Since, the cutting positions C1, C2 are provided at different heights with respect to one another, the transport paths P1, P2 extend, at least partially, at different levels with respect to one another. The transport paths P1, P2 in FIG. 2 extend horizontally. In FIG. 2, the transport path P1 extends above the main media transport path MP while the second media transport path P2 extends below the first media transport path P1.

In FIG. 2, the first medium M1 is directed upwards to the first cutting position C1 via a first selector guide 11 or first switch guide 11. Likewise, a second selector guide 12 or a second switch guide 12 is arranged for guiding the second medium M2 via the second transport path P2 to the second cutting position C2 below the first cutting position C1. The selector guides 11, 12 may be static, but preferably the selector guides 11, 12 of the switch device 10 comprise a selector actuator 13, 14 for positioning selector guides 11, 12, with respect to one of the transport paths P1, P2. Each selector guide 11, 12 in FIG. 2 comprises a guide plate 11, 12 pivotable between a plurality of vertically spaced apart positions, each of which is located at a starting end of one of the plurality of transport paths P1, P2. The pivotable selector guides 11, 12 are then controlled by means of the controller 40 to direct a medium M1, M2 to a respective cutting position C1, C2 based on the print job data. In a basic example, the relative length or width of the image to be printed on a medium M1 compared to the other media M2 determines the selection of the transport path P1, P2 by the selector guide 11.

In FIG. 2, each of the transport paths P1, P2 comprises a cutter 31, 32 positioned for cutting a medium M1, M2 at the respective cutting position C1, C2. The cutters 31, 32 may be actuated independently from one another, such that one of the cutters 31, 32 may cut a respective one of the media M1, M2 without the other of the cutters 31, 32 cutting the respective other of the media M1, M2. The cutting device 30 comprises cutter 31, 32, for example a knife element, preferably a rotatable knife element. The cutting device 30 is arranged for moving the cutter 31, 32 in a cutting direction perpendicular to the transport direction D over the plane of the medium M1, M2 for cutting the medium M1, M2. To this end, the cutter 31 may be provided on a guide rail extending in the width direction W over and parallel to a medium M1, M2. In FIG. 2, the cutters 31, 32 are arranged to move horizontally and are supported by support rail 33. Preferably, the cutters 31, 32 are arranged to move across the width of the main media transport path MP. As such a cutter 31, 32 generally resides at a lateral side of the main media transport path MP. The cutter 31, 32 may be provided at a predetermined angle with respect to the plane of the medium M1, M2 to improve cutting. After cutting the cutter may be repositioned at its starting positioned in a return stroke, so no re-orientation of the angled cutter 31, 32 is required.

FIG. 3 schematically illustrates a side view of another embodiment of a printing system 1' according to the present invention. The configuration of the embodiment in FIG. 3 is similar to the embodiment shown in FIG. 2, and only the differences will be discussed. In FIG. 3, the switch device 10' comprises guide plates 11', 12' rigidly connected to a frame of the printing system 1'. Each guide plate 11', 12' is thereby permanently or securely connected to a respective one of the transport paths P1, P2. Downstream of the switch device 10', each of the media M1, M2 extend parallel to one another on different height levels H1, H2 with respect to one another. Each transport path P1, P2 comprises a cutting position C1, C2. A cutting device 30' is provided for cutting each of the media M1, M2 at its respective cutting position C1, C2 along the dashed lines indicated in FIG. 2. The cutter 31' in FIG. 3 is moveable between different vertical levels H1, H2, each of which corresponds to one of the cutting positions C1, C2. A switch actuator in the form of a height adjustment actuator 33' is provided for adjusting the height of the cutter 31'. To this end, the cutting device 30 may comprise a vertically extending guide rail 33' for guiding the cutter 31' in the height direction. The height or position of the cutter 31' is controlled by the controller 40 based on the print job data. The controller 40 is arranged for positioning the cutter 31' at a cutting position C1, C2 for cutting a medium M1, M2 at said cutting position C1, C2, preferably at the start of the print job and even more preferably based on a relative length of an image to be printed on a medium M1, M2. The embodiment of FIG. 2 may be combined with the embodiment of FIG. 3 to form a printing system according to the present invention with both a pivotable switch device 10 as in FIG. 2 and a vertically moveable cutter 31' as in FIG. 3.

Figure 4A:
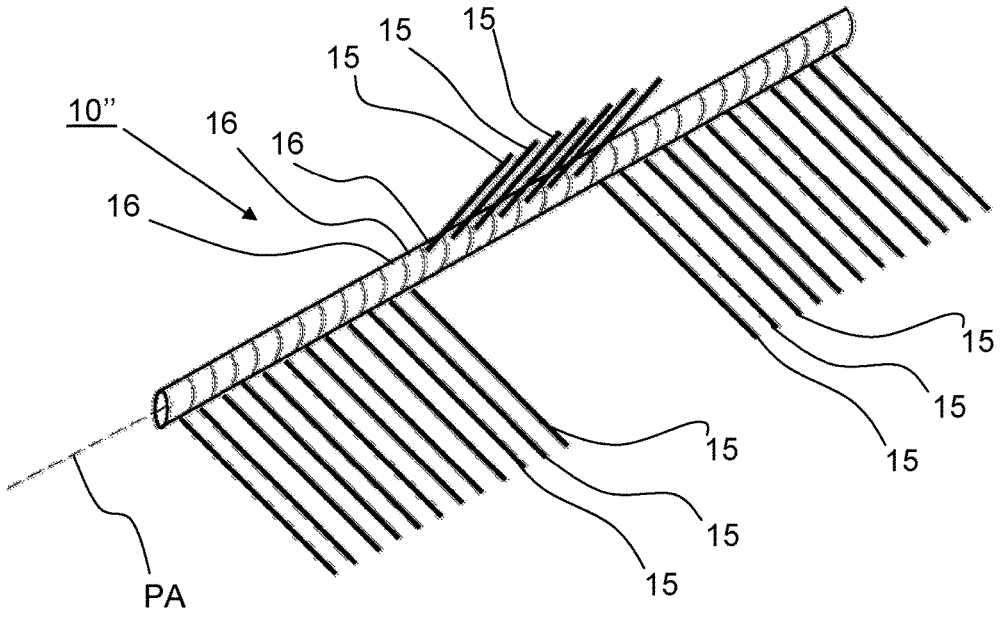
FIG. 4A-B are respectively a perspective view and a side view of a switch device of a cutting assembly according to the present invention.
Figure 4B:
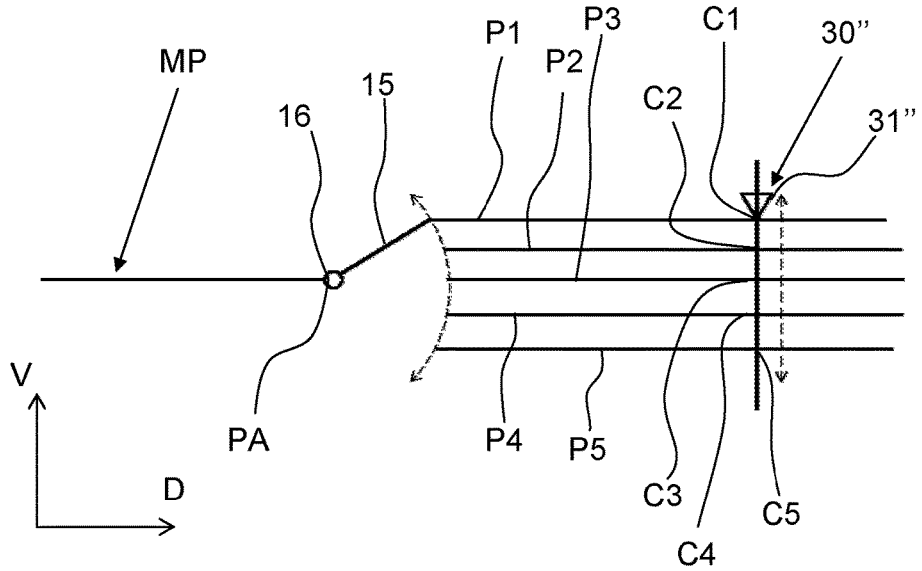

In a further embodiment shown in FIG. 4A-B, the switch device 10" comprises a plurality of pivotable guide elements, such as guide plate elements or guide finger elements 15, each independently pivotable around a common pivoting axis PA. The guide elements 15 are positioned side by side along the width direction W (shown in FIG. 1), preferably over the width of the main media transport path MP. Each guide element 15 is provided with a guide element actuator 16 which allows it be pivoted independently of other guide elements 15. The controller 40 controls the number of guide elements 15 to be positioned at a specific pivoting position or height level, as illustrated in FIG. 4B. Each pivoting position corresponds to a specific transport path P1-P5. The number of guide elements 15, which is positioned by the controller 40 at a specific pivoting position, corresponds to a width of the respective medium M1, M2 to be transported along the respective transport path P1-P5. In this manner, the width of the switch guide 11, 12 in FIG. 2 is adjustable to match or be similar to the width of the medium M1, M2. The controller 40 pivots at least the guide elements 15 positioned inside a projection of the respective medium M1, M2 along the transport path P1-P5, MP or the transport direction D. The widths of the media M1, M2 may be detected via a sensor or be input to the controller 40 as part of the print job. The controller 40 adjusts the orientation of the guide fingers or plates 15 to support the respective medium M1, M2 along its full width as it is being transported over the switch device 10". The cutting assembly 1 according to the present invention is thus arranged for processing any plurality of rolls R1, R2 of a wide variety of widths without intervention by an operator.

Figure 5:
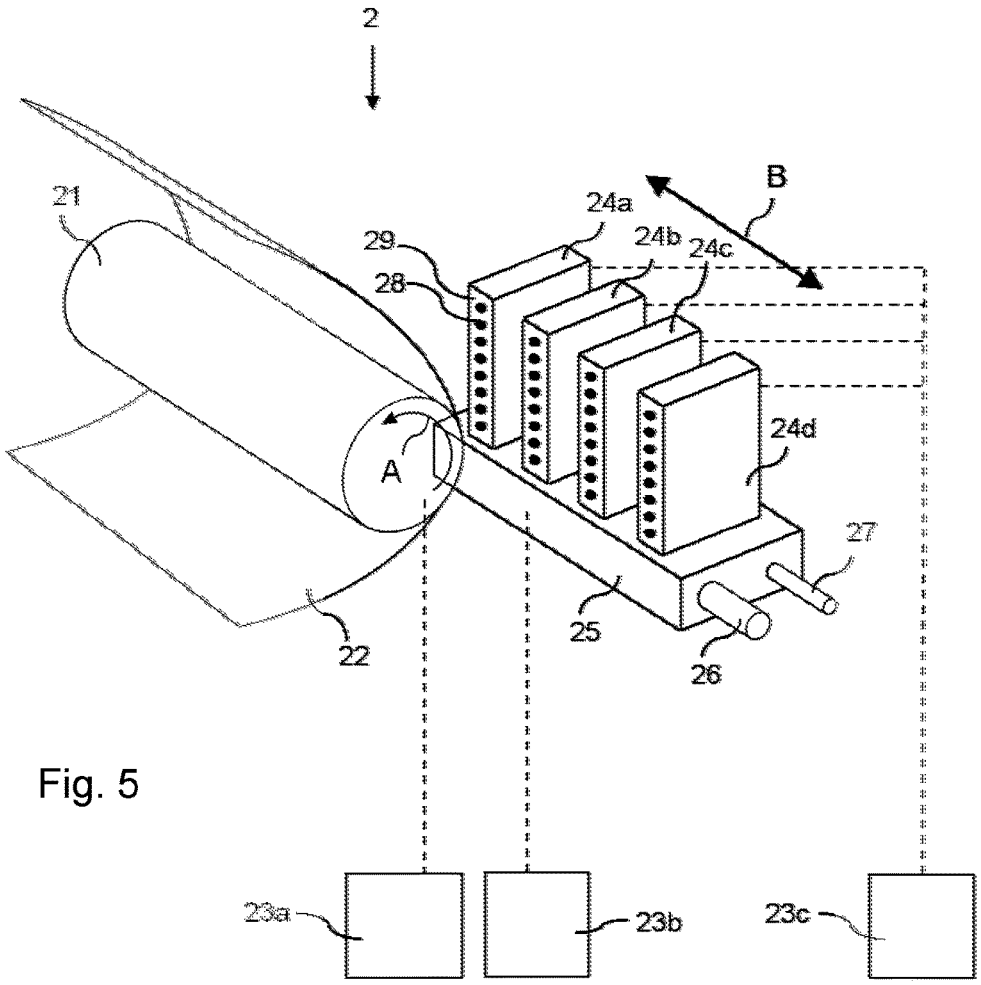
FIG. 5 is an inkjet printing assembly for a multi-roll printing system in FIG. 2 and FIG. 3.

FIG. 5 shows an ink jet printing assembly 2. The ink jet printing assembly 2 comprises supporting means for supporting an image receiving member 22 being a part of the medium M1, M2. The supporting means 21 are shown in FIG. 5 as a platen 21, but alternatively, the supporting means may be a flat surface. The platen 21, as depicted in FIG. 5, is a rotatable drum 21, which is rotatable about its axis as indicated by arrow A. The supporting means 21 may be optionally provided with suction holes for holding the image receiving member 22 in a fixed position with respect to the supporting means 21. The ink jet printing assembly 2 comprises print heads 24*a*-24*d*, mounted on a scanning print carriage 25. The scanning print carriage 25 is guided by suitable guiding means 26, 27 to move in reciprocation in the main scanning direction B. Each print head 24*a*-24*d* comprises an orifice surface 29, which orifice surface 29 is provided with at least one orifice 28. The print heads 24*a*-24*d* are configured to eject droplets of marking material onto the image receiving member 22. The platen 21, the carriage 25 and the print heads 24*a*-24*d* are controlled by suitable controlling means 23*a*, 23*b* and 23*c*, respectively.

The image receiving member 22 may be a medium M1, M2 in web or in sheet form and may be composed of e.g. paper, cardboard, label stock, coated paper, plastic or textile. Alternatively, the image receiving member 22 may also be an intermediate member, endless or not. Examples of endless members, which may be moved cyclically, are a belt or a drum. The image receiving member 22 is moved in the sub-scanning direction A by the platen 21 along four print heads 24*a*-24*d* provided with a fluid marking material.

A scanning print carriage 25 carries the four print heads 24*a*-24*d* and may be moved in reciprocation in the main scanning direction B parallel to the platen 21, such as to enable scanning of the image receiving member 22 in the main scanning direction B. Only four print heads 24*a*-24*d* are depicted for demonstrating the invention. In practice an arbitrary number of print heads may be employed. In any case, at least one print head 24*a*-24*d* per color of marking material is placed on the scanning print carriage 25. For example, for a black-and-white printer, at least one print head 24*a*-24*d*, usually containing black marking material is present. Alternatively, a black-and-white printer may comprise a white marking material, which is to be applied on a black image-receiving member 22. For a full-color printer, containing multiple colors, at least one print head 24*a*-24*d* for each of the colors, usually black, cyan, magenta and yellow is present. Often, in a full-color printer, black marking material is used more frequently in comparison to differently colored marking material. Therefore, more print heads 24*a*-24*d* containing black marking material may be provided on the scanning print carriage 25 compare 2d to print heads 24*a*-24*d* containing marking material in any of the other colors. Alternatively, the print head 24*a*-24*d* containing black marking material may be larger than any of the print heads 24*a*-24*d*, containing a differently colored marking material.

The carriage 25 is guided by guiding means 26, 27. These guiding means 26, 27 may be rods as depicted in FIG. 5. The rods may be driven by suitable driving means (not shown). Alternatively, the carriage 25 may be guided by other guiding means, such as an arm being able to move the carriage 25. Another alternative is to move the image receiving material 22 in the main scanning direction B, parallel to the width direction W.

Each print head 24*a*-24*d* comprises an orifice surface 29 having at least one orifice 28, in fluid communication with a pressure chamber containing fluid marking material provided in the print head 24*a*-24*d*. On the orifice surface 29, a number of orifices 28 is arranged in a single linear array parallel to the sub-scanning direction A. Eight orifices 28 per print head 24*a*-24*d* are depicted in FIG. 5, however obviously in a practical embodiment several hundreds of orifices 28 may be provided per print head 24*a*-24*d*, optionally arranged in multiple arrays. As depicted in FIG. 5, the respective print heads 24*a*-24*d* are placed parallel to each other such that corresponding orifices 28 of the respective print heads 24*a*-24*d* are positioned in-line in the main scanning direction B. This means that a line of image dots in the main scanning direction B may be formed by selectively activating up to four orifices 28, each of them being part of a different print head 24*a*-24*d*. This parallel positioning of the print heads 24*a*-24*d* with corresponding in-line placement of the orifices 28 is advantageous to increase productivity and/or improve print quality. Alternatively multiple print heads 24*a*-24*d* may be placed on the print carriage adjacent to each other such that the orifices 28 of the respective print heads 24*a*-24*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 28.

Upon ejection of the marking material, some marking material may be spilled and stay on the orifice surface 29 of the print head 24*a*-24*d*. The ink present on the orifice surface 29, may negatively influence the ejection of droplets and the placement of these droplets on the image receiving member 22. Therefore, it may be advantageous to remove excess of ink from the orifice surface 29. The excess of ink may be removed for example by wiping with a wiper and/or by application of a suitable anti-wetting property of the surface, e.g. provided by a coating.

FIGS. 6A-I and 7 show the various steps of a method according to the present invention. In step i, the print job is initiated by inputting the print job data to the controller 40. The print job data comprises the information required for printing the respective images on the respective media M1, M2. The print job data comprises first print job data related to the first image to be printed on the first medium M1, and second print job data representing the second image to be printed on the second medium. From the first and second print job data the controller 40 may determine the dimensions and/or positions of the images on the media M1, M2, for example from the dimensions of the image, their desired positions on the media, and/or the current positions of the media along the transport path. Thereby, the positions of the cutting lines where the media are to be cut are determined.

Based on said print job data, the controller 40 designates or selects in step ii one of the plurality of media M1, M2 provided on the roll support 5. The controller 40 may further in this step select others of the plurality of media M1, M2 for example to determine a cutting order. The selection is preferably based on a comparison between the first and second print job data. For example by comparing the dimensions of each image to be printed on each respective medium M1, M2, specifically the length of each image in the transport direction D, the controller 40 designates or selects the medium M1 which is to be cut first, i.e. prior to the other media M2. In a basic example, the medium M1 to be printed with the image with the relatively shortest length is designated or selected. Further images may be designated or selected based on their relative image length. By repeated selection, a cutting order of the media M1, M2 may be determined.

In step iii, the controller 40 for each medium M1, M2 designated or selected in step i designates or selects or determines a cutting position C1, C2, whereto the designated or selected medium M1, M2 is to be transported. Thereby, the controller 40 associates each of the media M1, M2 with a cutting position C1, C2. In the example of FIG. 2, the controller 40 may actuate the selector guides 11, 12 of the switch device 10 into such positions that each of the designated or selected media M1, M2 is directed to their associated designated or selected cutting position C1, C2. A corresponding transport path P1, P2 is thus designated or selected by the controller 40 to transport each medium M1, M2 designated or selected in step ii to one of the cutting positions C1, C2. Alternatively, in the embodiment in FIG. 2, the cutter 31' is positioned at the designated or selected cutting position C1, C2. For example, the cutter 31' is positioned at the cutting position C1, C2 for the medium M1, M2 to be printed with the image with the shortest length, since this medium M1, M2 will first require cutting with respect to the other media M1, M2.

Figure 6A:
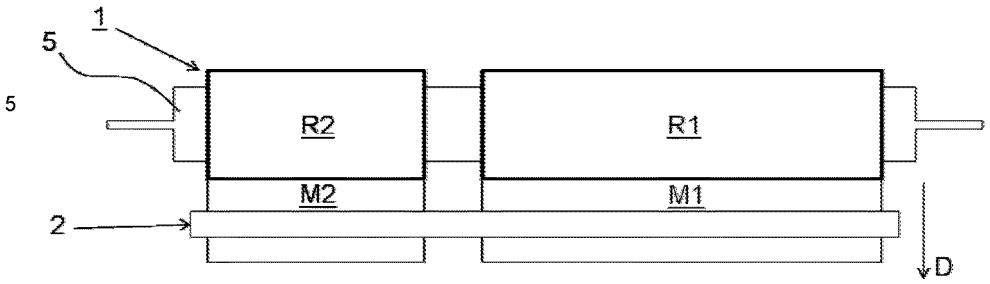
FIGS. 6A-I are schematic top views of a multi-roll printing system in FIG. 2 during various steps of a method according to the present invention.
Figure 6B:
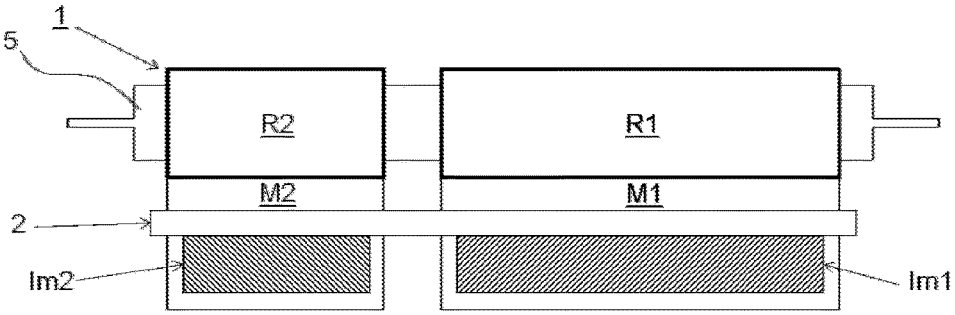
Figure 6C:
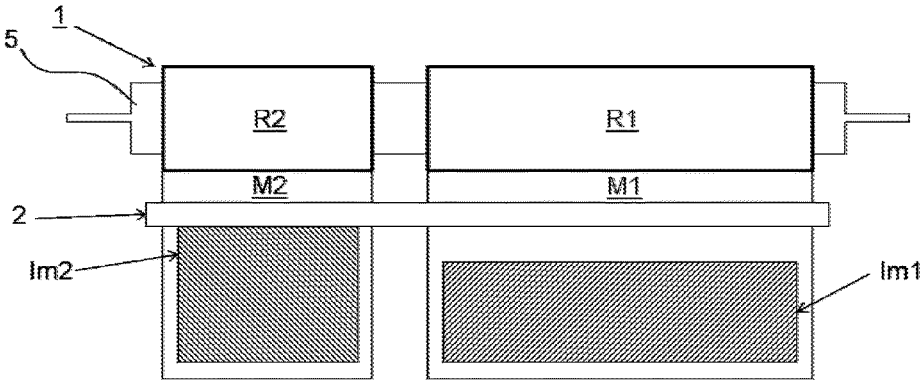

In step iv, the roll support 5 is actuated and the media M1, M2 are stepwise advanced along the transport path P. Since all rolls R1, R2 are provided on a single roll support 5, the media M1, M2 move synchronously towards the inkjet printing assembly 2, as shown in FIG. 6A. In between advancement steps, the inkjet printing assembly 2 prints consecutive swath of the images Im1, Im 2 on their respective media M1, M2, as determined by the print job data. The images Im1, Im2 are printed in tandem (i.e. in parallel swaths) on their respective media M1, M2, as shown in FIG. 6B.

In step v, which may be comprised in step iv, each of the designated or selected media M1, M2 is transported onto its designated or selected transport path P1, P2. Thereby each of the media M1, M2 is transported to a one of the cutting positions C1, C2. The cutting positions C1, C2 are positioned at different height levels H1, H2, such that downstream of the inkjet printing assembly 2 the individual transport paths P1, P2 for the different media M1, M2 diverge into different relative directions or levels H1, H2. Thus, based on the selection each medium M1, M2 is transported to a different height for cutting said medium M1, M2.

Figure 6D:
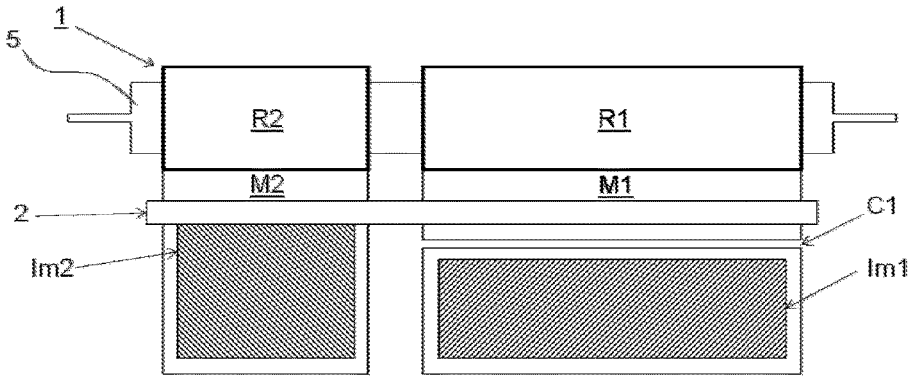

In step vi and FIG. 6D, printing of a first image Im1 on one of the media M1, M2 has been completed. This medium M1 is then cut by moving the cutter 31, 32, 31' traverse to the transport direction D across the plane of said medium M1. The medium M1 is cut along a cutting line or region positioned on the medium M1 between a first image Im1 printed on it and the inkjet print assembly 2. Since the cutting position C1 of said medium M1 is vertically spaced apart from the other cutting positions C2 said medium M1 may be cut without cutting the other media M2, as shown in FIG. 6D. The region of said medium M1 printed with the first image Im1 may then be removed from its respective transport path P1, P2 and be processed for storage, packing and/or finishing, as shown in FIG. 6E.

Figure 6E:
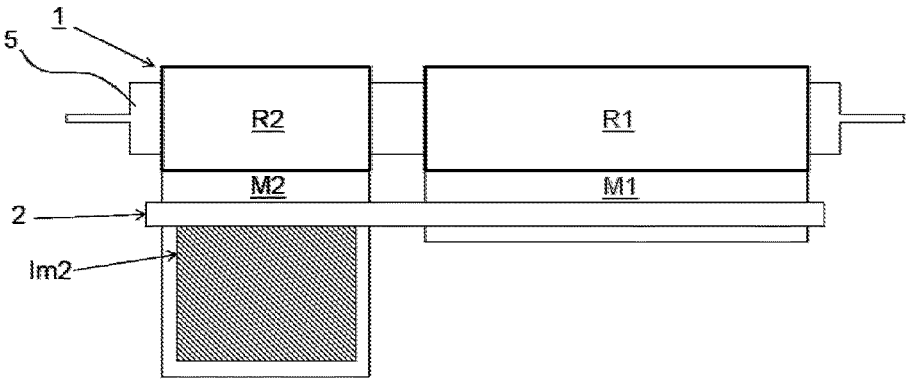
Figure 6F:
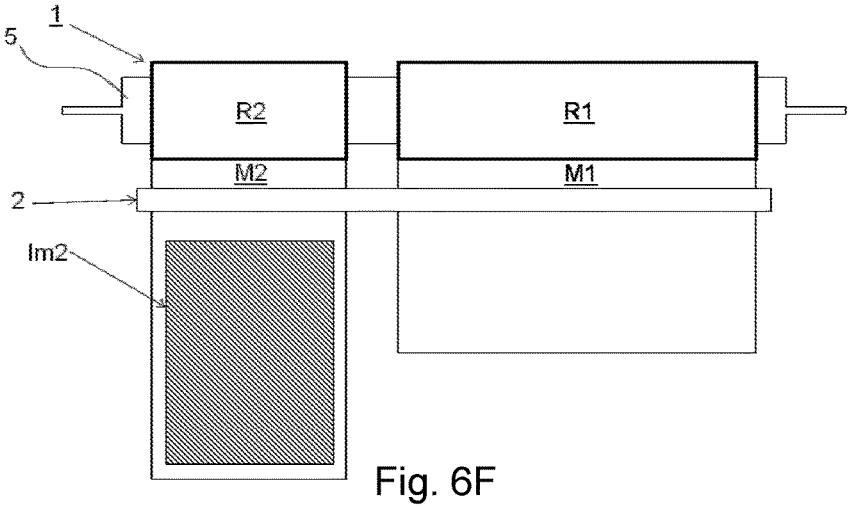

In FIG. 6E and in step vii, printing and transporting of the media M1, M2 is continued after the cutting in step vi. The roll support 5 is actuated and the inkjet printing assembly 2 continues to print the second image on a further medium M2. Printing of the second image Im2 commenced in step iv, but the relative length of the second image Im2 exceeded that of the first image Im1. Since the media M1, M2 are advanced in tandem the cut medium M1 is advanced along with the further medium M2 being printed in FIG. 6E. Generally, in this step no image is printed on the medium M1 which was cut in step vi, such that upon completion of printing the second image Im2, a parallel region of the first medium M1 remains blank, as shown in FIG. 6F.

Figure 6G:
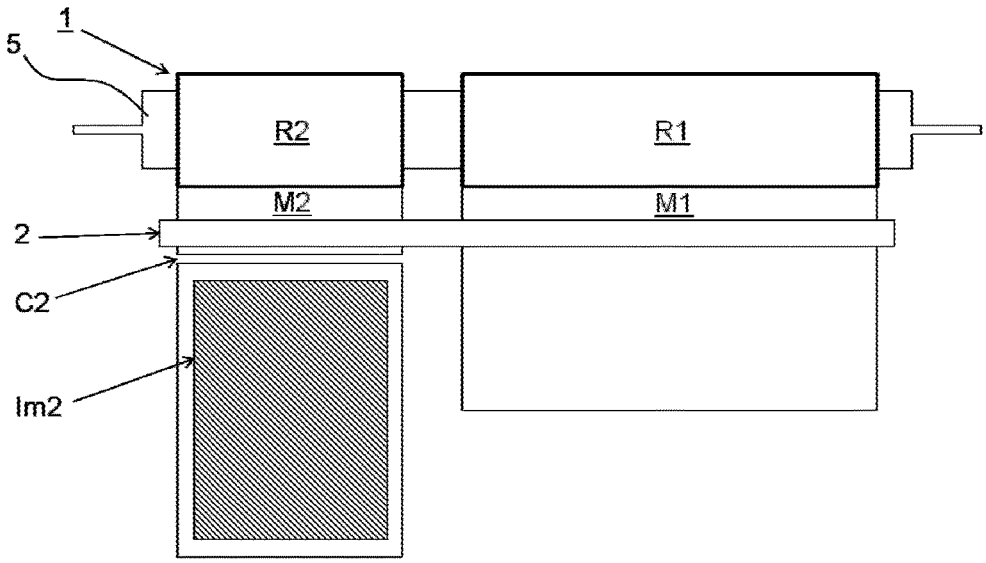
Figure 6H:
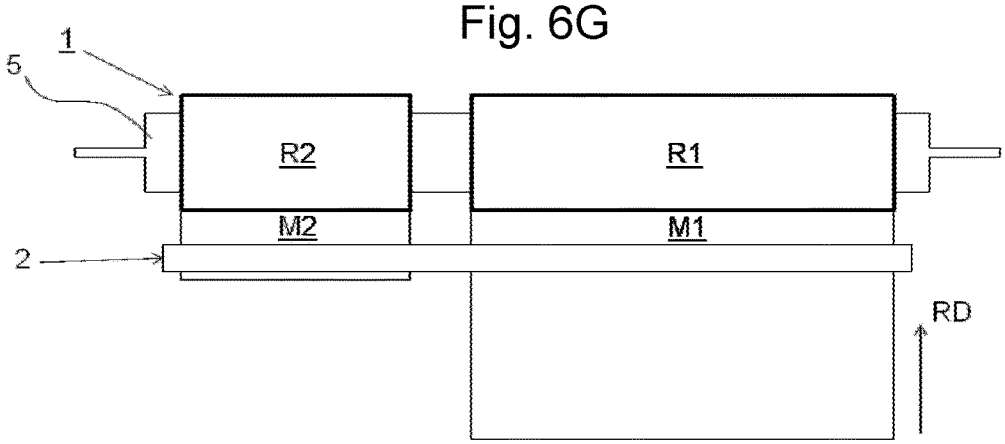
Figure 6I:
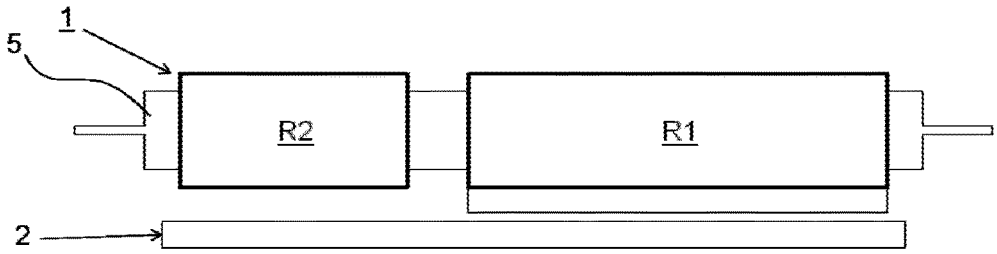
Figure 7:
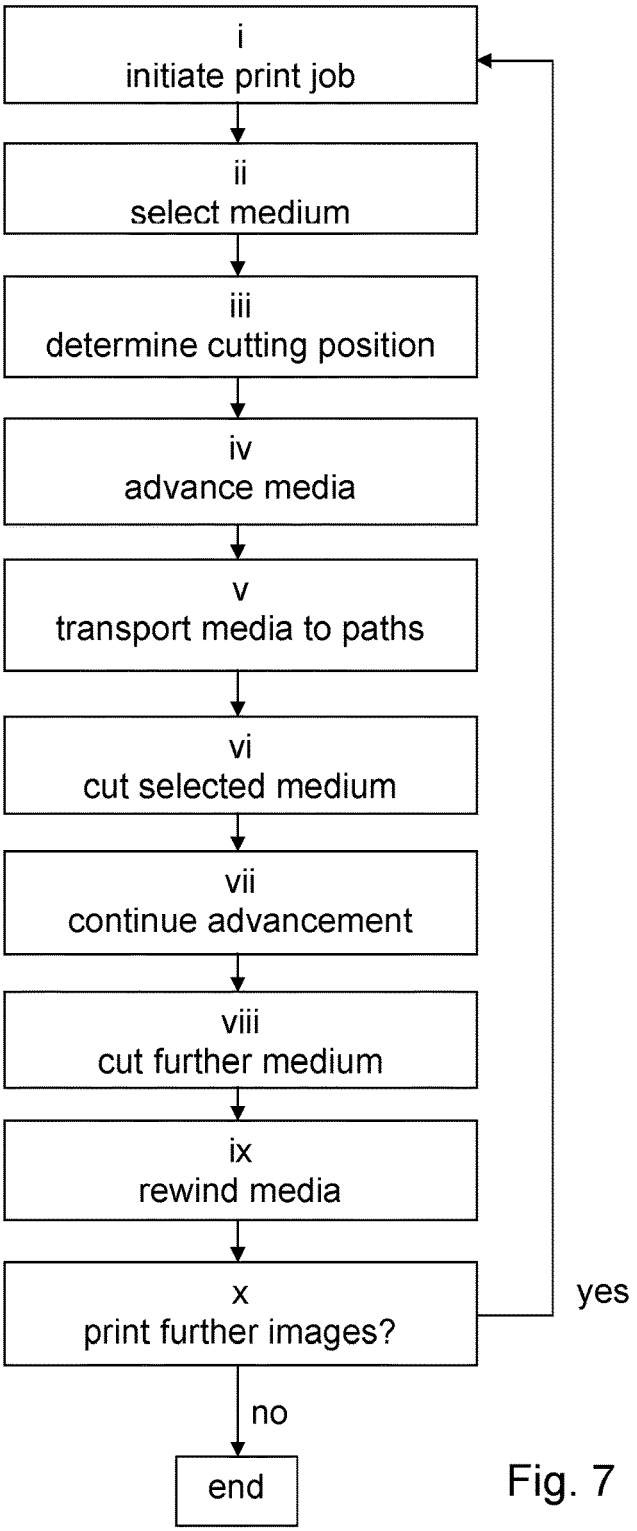
FIG. 7 is a diagram representing various steps of a method according to the present invention.

When the second image Im2 has been printed on the further medium M2, the further medium M2 in step viii is positioned at the other cutting position C2, such that the desired cutting region of the further medium M2 may be cut by the cutter 31, 31', 32 at the other cutting position C2. The cutter 31, 31', 32 may prior to or in this step be positioned at the other cutting position by means of the height adjustment actuator 33'. The cutter 31, 31', 32 then moves traverse to the transport direction D across the further medium M2, releasing the region of the further medium M2 with the second image Im2 printed on it from the remained of the medium M2, as illustrated in FIG. 6G.

Since the length of the second image Im2 exceeded that of the first image Im1, the medium M1 cut in step vi extends beyond the new leading edge of the further medium M2 cut in step viii. In step ix, the roll support 5 is rotated in a reverse rotation direction opposite to the rotation direction applied in step iv, such that the media M1, M2 are transport upstream back towards the rolls R1, R2 in the reserve direction RD. The media M1, M2 are partially wound back onto the rolls R1, R2. Thereby, the leading edge of the medium M1 cut in step vi is positioned with respect to the inkjet printing assembly 2 for further printing on said medium M1, as illustrated in FIG. 61. The printing process may then commence for further printing on the media M1, M2.

An even further image may thus be printed on the media M1, M2 in step x without the loss of print media. For printing further images in step x, the steps i to ix may be repeated. Thus, the present invention provides a method of printing on a multi-roll printer in a cost-effective manner.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A method for cutting media from a multi-roll printing system, the method comprising the steps of:

supplying a first medium and second medium in web form from a first media roll and second media roll, the first media roll and second media roll being provided on a common roll support;

transporting the first and second web medium to a cutting device downstream of an inkjet printing assembly;

designating one of the first medium and the second medium as a designated medium to be cut, which first medium and second medium are output in parallel with respect to one another from the multi-roll printing system;

transporting the designated medium to a cutting media transport path spaced apart from a further media transport path in a traverse direction perpendicular to a plane of the cutting media transport path, such that, when viewed in the traverse direction, the designated medium on the cutting media transport path is non-overlapping with the other of the first medium and the second medium on the further media transport path; and cutting the designated medium positioned at the cutting media transport path.

2. The method according to claim 1, wherein the step of designating one of the first medium and the second medium further comprises a controller comparing first print job data for a first image to be printed on the first medium to second print job data for a second image to be printed on the second medium.

3. The method according to claim 1, further comprising the step of positioning a cutting device and the designated medium with respect to one another at the cutting media transport path for cutting the designated medium.

4. The method according to claim 1, further comprising the steps of:

supplying a third medium and a fourth medium in web form;

if the cutting step comprises simultaneously cutting the third medium and the fourth medium, transporting the other of the third medium and the fourth medium to a similar level in the traverse direction as the cutting media transport path; and if the cutting step comprises consecutively cutting the third medium and the fourth medium, transporting the other of the third medium and the fourth medium to the further media transport path positioned spaced apart from the plane of the cutting media transport path in the traverse direction.

5. The method according to claim 1, further comprising the steps of:

after the step of cutting the designated medium, further transporting the first medium and the second medium in a transport direction;

cutting the other one of the first medium and the second medium; and transporting the first medium and the second medium in a reverse direction opposite to the transport direction.

6. The method according to claim 1, wherein the step of transporting the media comprises transporting the second medium in tandem with the first medium.

7. The method according to claim 1, wherein the step of transporting the first medium and the second medium comprises rotating the common roll support.

8. A cutting assembly for a multi-roll printing system, comprising:

a main media transport path for a plurality of media output by a multi-roll printing system, the main media transport path being configured to transport the plurality of media in a same transport direction;

a switch device positioned downstream of the main media transport path and arranged for transporting one of the plurality of media to a cutting media transport path and for transporting another one of the plurality of media to a further media transport path, wherein the further media transport path is spaced apart from the cutting media transport path in a traverse direction perpendicular to a plane of the cutting media transport path, such that, when viewed in the traverse direction, a medium on the cutting media transport path is non-overlapping with a medium on the further media transport path; and a cutting device arranged for cutting the one of the plurality of media at the cutting media transport path.

9. A cutting assembly according to claim 8, wherein the switching device is further arranged for:

when two media are designated for simultaneous cutting, positioning one of the two media on the cutting media transport path and positioning the other one of the two media at a similar level in the traverse direction as the cutting media transport path; and when two media are designated for consecutive cutting, positioning one of the two media at the cutting media transport path and positioning the other one of the two media on the further media transport path spaced apart from the cutting media transport path in the traverse direction.

10. The cutting assembly according to claim 8, further comprising a switch actuator for positioning the cutting device and the one of the plurality of media with respect to one another at the cutting media transport path for cutting the one of the plurality of media.

11. The cutting assembly according to claim 10, wherein the main media transport path, cutting media transport path, and the further media transport path each comprise at least two lanes for the at least two media, said lanes extending parallel to one another in the transport direction, and wherein the cutting assembly further comprises at least two transport switches, each of which is positioned at one of the parallel lanes, which at least two transport switches are actuatable by the switch actuator to selectively connect a lane on the main media transport path to a lane on the cutting media transport path or to a lane on the further media transport path.

12. The cutting assembly according to claim 8, further comprising a controller arranged for designating one of the plurality of media based on a comparison between first print job data for a first image to be printed on a first one of the plurality of media and second print job data for a second image to be printed on a second one of the plurality of media.

13. The cutting assembly according to claim 11, wherein the switch device comprises a plurality of guide elements, each of which is pivotable around a pivoting axis to position the guide element with respect to one of the cutting media transport path and the further media transport path.

14. The cutting assembly according to claim 8, comprising:

a plurality of cutting media transport paths spaced apart from one another in the traverse direction perpendicular to a plane of the cutting media transport paths;

a plurality of cutting devices, wherein a cutting device is positioned at each of the cutting media transport paths for cutting a medium on said cutting media transport path;

a switch device downstream of main media transport path, the switch device comprising a plurality of guide elements, each of which is moveable to position the guide element with respect to one of the cutting media transport paths, such that a first medium is transported from the main media transport path to a first cutting media transport path while a second medium is medium is transported from the main media transport path to a second cutting media transport path.

15. A multi-roll printing system according to claim 14, further comprising a support roll for holding a plurality of media rolls for supplying the plurality of media and a roll actuator for rotating the support roll.

16. A method for cutting media from a multi-roll printing system, the method comprising the steps of:

providing a main media transport path for a plurality of media output by a multi-roll printing system;

providing a switch device positioned downstream of the main media transport path and arranged for transporting one of the plurality of media to a cutting media transport path and for transporting another one of the plurality of media to a further media transport path, wherein the further media transport path is spaced apart from the cutting media transport path in a traverse direction perpendicular to a plane of the cutting media transport path, such that, when viewed in the traverse direction, a medium on the cutting media transport path is non-overlapping with a medium on the further media transport path;

providing a cutting device arranged for cutting the one of the plurality of media at the cutting media transport path;

when two media are designated for simultaneous cutting, positioning one of the two media on the cutting media transport path and positioning the other one of the two media at a similar level in the traverse direction as the cutting media transport path; and when two media are designated for consecutive cutting, positioning one of the two media at the cutting media transport path and positioning the other one of the two media on the further media transport path spaced apart from the cutting media transport path in the traverse direction; and cutting the designated media positioned at the cutting media transport path.

* * * * *